US006893291B2

(12) United States Patent
Wendling et al.

(10) Patent No.: US 6,893,291 B2
(45) Date of Patent: May 17, 2005

(54) COAXIAL PLUG CONNECTOR HAVING A LONGITUDINALLY DIVIDED SHIELD HOUSING, AND COAXIAL ANGLED PLUG CONNECTOR

(75) Inventors: Hannes Jahn Wendling, Langen (DE); Olivier De Cloet, Bensheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/612,258

(22) Filed: Jul. 2, 2003

(65) Prior Publication Data

US 2004/0058582 A1 Mar. 25, 2004

(30) Foreign Application Priority Data

Jul. 2, 2002 (EP) ..... 02014816

(51) Int. Cl.[7] ..... H01R 9/05
(52) U.S. Cl. ..... 439/582; 439/585
(58) Field of Search ..... 439/578–585, 439/932

(56) References Cited

U.S. PATENT DOCUMENTS

| | | | | |
|---|---|---|---|---|
| 3,363,221 A | | 1/1968 | Stark | 339/177 |
| 5,263,877 A | * | 11/1993 | Mitani | 439/585 |
| 5,879,190 A | * | 3/1999 | Maruyama et al. | 439/582 |
| 6,283,790 B1 | | 9/2001 | Idehara et al. | 439/582 |
| 6,508,668 B1 | * | 1/2003 | Yamane | 439/582 |
| 6,575,769 B1 | * | 6/2003 | Takeuchi et al. | 439/74 |
| 2002/0180272 A1 | | 12/2002 | Yuasa et al. | |

FOREIGN PATENT DOCUMENTS

| | | | |
|---|---|---|---|
| DE | 19932942 | A1 | 7/1999 |
| EP | 0244657 | A1 | 11/1987 |
| EP | 0412412 | A1 | 7/1990 |
| EP | 0597597 | A2 | 10/1993 |
| EP | 0884800 | A3 | 5/1998 |
| EP | 0884800 | A2 | 5/1998 |
| EP | 1050932 | A2 | 11/2000 |
| EP | 1050932 | A3 | 11/2000 |
| GB | 238963 | | 8/1925 |
| GB | 463406 | | 3/1937 |
| GB | 614681 | | 12/1948 |
| GB | 719849 | | 12/1954 |
| WO | WO97/11511 | | 3/1997 |

* cited by examiner

*Primary Examiner*—Gary Paumen
(74) *Attorney, Agent, or Firm*—Barley Snyder

(57) ABSTRACT

The present invention relates to a coaxial plug connector having an electrically conductive shield housing and having an center conductor and an outer conductor. The outer conductor includes a first half shell and a second half shell which can be joined together in a direction substantially transverse with respect to the longitudinal axis of the cable. Furthermore, the invention relates to a coaxial angled plug connector in which the center conductor is angled such that the contact region and the connection region substantially form a right angle with one another. Finally, the invention relates to a process for making plug connectors of this type. In order to specify a coaxial plug connector and a coaxial angled plug connector and an associated manufacturing process as a result of which better electrical contact and insensitivity to electromagnetic interference are made possible at the same time as a simplified and less expensive means of manufacture, in the coaxial plug connector according to the invention the half shells of the outer conductor form the electrically conductive shield housing. The angled plug connector according to the invention has an center conductor made as a turned part.

19 Claims, 12 Drawing Sheets

COAXIAL PLUG CONNECTOR HAVING A LONGITUDINALLY DIVIDED SHIELD HOUSING, AND COAXIAL ANGLED PLUG CONNECTOR

FIELD OF THE INVENTION

The present invention relates to a coaxial plug connector having an electrically conductive two part shield housing and having an center conductor, which is connectable to a cable center conductor and to a complementary center conductor of a mating plug connector, and an outer conductor which is connectable to an outer conductor of the mating plug connector and to a cable outer conductor. Furthermore, the invention relates to a coaxial angled plug connector in which the center conductor is angled such that the contact region and the connection region are oriented at approximately a right angle to each other. Finally, the invention relates to a process for making a coaxial plug connector or coaxial angled plug connector.

BACKGROUND

Coaxial plug connectors are generally used in a broad range of applications to connect coaxial cables to one another or to a number of electronic components. Coaxial cables are the predominant type of cabling in the field of image transfer and for computer networks, since although they are more expensive than simple telephone cables, they are substantially less susceptible to disruptive interference and can transport more data. As the quantity of data to be transferred increases in the automotive sector, coaxial cabling use is increasing too, in particular for connecting the radio, GPS (Global Positioning System) or mobile radio devices to the onboard network of the motor vehicle.

Another area of application is telecommunications, where coaxial plug connectors are used for example for the greatest variety of connections in the base stations of mobile communications networks.

In general, a coaxial connector includes two substantially concentric conductors, a center signal conductor and an outer shield conductor which are insulated from one another by a dielectric and are conventionally used as a connection point for a transmission line. Angled coaxial plug connectors have been developed for connecting coaxial cables of lines running substantially transverse to one another. In the prior art, a number of techniques for connecting the center conductor and the outer conductor to the cable are proposed. As disclosed for example in WO 97/11511, an angled plug connector has the center conductor terminated by an insulation displacement contact and the outer conductor terminated by a crimp connection. With a straight coaxial plug connector, the cable center conductor is terminated by a crimp or solder connection and the cable outer conductor is terminated by a insulation displacement contact. According to WO 97/11511, and also EP 0 412 412 A1, in the case of an angled plug connector the center conductor of the plug connector and the cable center conductor meet in the plug connector such that they form a right angle and are connected to one another for example by way of a slot or a notch in the center conductor. As an alternative to this method of connection, however, angled center conductors may also be used in angled plug connectors.

An example of an angled center conductor of this kind is disclosed by DE 199 32 942 A1. The angled center conductor is in this case made as a punched bent metal part and connected to the center conductor of the cable by a crimp connection.

DE 199 32 942 A1 also discloses an angled plug connector in which an insulation displacement device upper part and an insulation displacement device lower part are provided in order to make contact with the cable outer conductor. When mated, the two-part insulation displacement device is received in a two-part socket housing made of synthetic material and is shielded by a push-on closure cap. This arrangement has the disadvantage that it requires a comparatively large number of parts and operating steps for its manufacture. Also, the problem of insufficient electrical shielding can occur, since the shield housing does not enclose the plug connector on all sides.

Making the center conductor as a stamped and formed metal part, as disclosed in DE 199 32 942 A1, has the disadvantage that manufacture is relatively complicated and that the requirements of mechanical stability and electrical contact resistance cannot always be adequately fulfilled.

In this case, pin-type center conductors, for example made in the form of a turned part, as disclosed in EP 0 884 800 A2 or EP 0 597 579 A2, provide a possible alternative.

SUMMARY

An object of the present invention is to provide a coaxial plug connector and a coaxial angled plug connector and an associated manufacturing process which result in better electrical contact and insensitivity to electromagnetic interference while simplifying and reducing the cost of manufacturing.

In accordance with the invention, this and other objects are achieved by a coaxial plug connector having an outer conductor having a first half shell and a second half shell which can be joined together in a direction substantially transverse with respect to the longitudinal axis, and these half shells of the outer conductor at the same time form the electrically conductive shield housing. The number of parts required and the process steps required can therefore be reduced, while the plug connector is surrounded peripherally by the shield housing. Interference is therefore reduced and relatively large quantities of data may be transmitted through the connector.

BRIEF DESCRIPTION OF THE DRAWINGS

The invention will be explained in more detail below with reference to the embodiments illustrated in the attached drawings. Similar or corresponding details of the subject matter of the invention are provided with the same reference numerals. In the drawings.

DETAILED DESCRIPTION OF THE PREFERRED EMBODIMENTS

Figure 1:
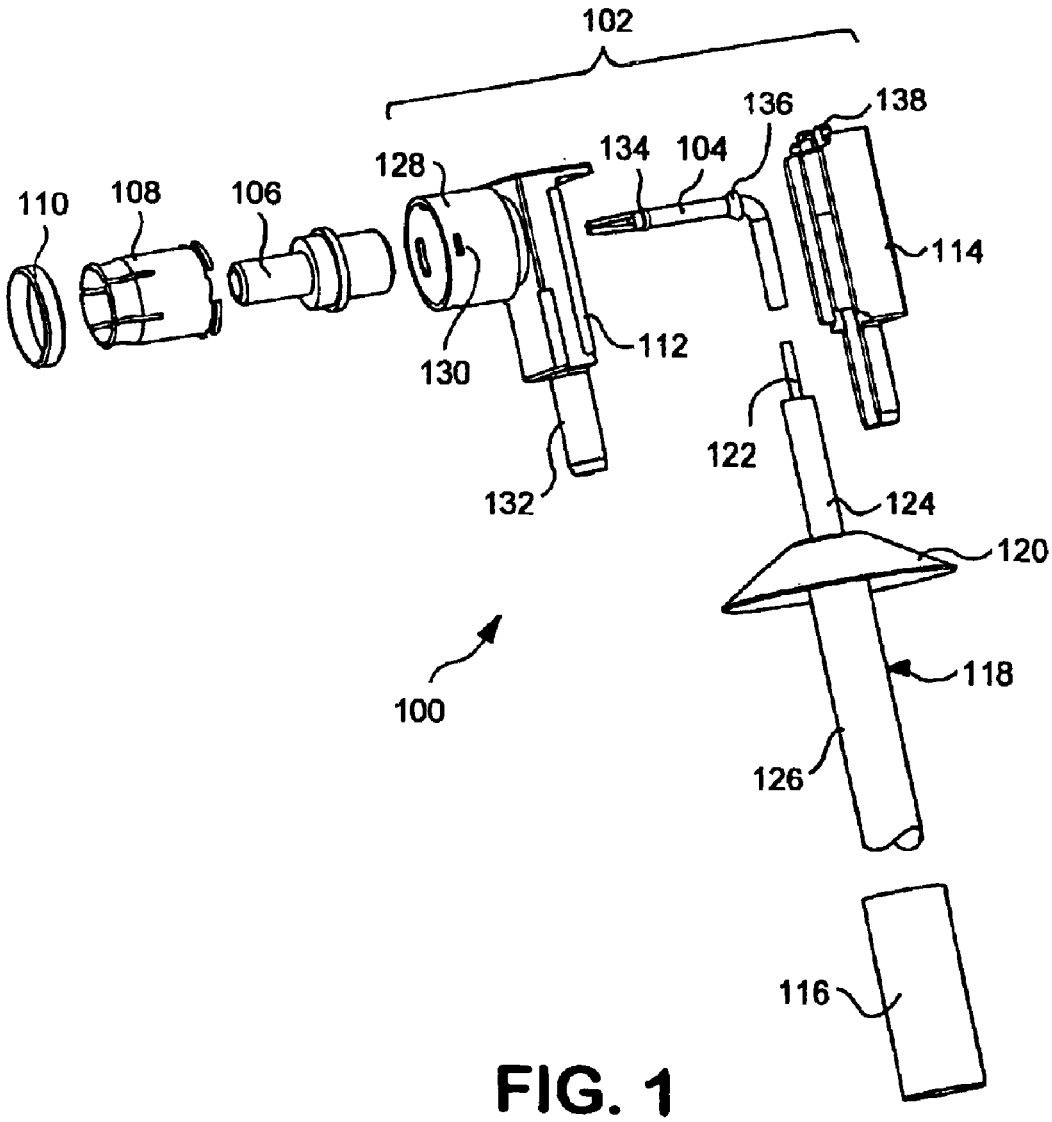
FIG. 1 is an exploded perspective view of a coaxial angled plug connector according to the invention.

FIG. 1 shows an exploded illustration of a coaxial plug connector 100 according to the invention in an angled orientation, together with a connection end of a coaxial cable 118 having its insulation removed. The coaxial plug connector 100 has an outer conductor 102 which is connectable to an outer conductor of a mating plug connector, not shown in this or the following figures, and to a cable outer conductor 120.

The outer conductor 102 is divided, parallel to the longitudinal axis of the cable 118, into two half shells 112 and 114 which form a substantially closed conductive shield housing. The connection between a cable center conductor 122 and a complementary center conductor (not shown) of a mating plug connector is made by the center conductor 104 of the coaxial plug connector. The center conductor 104 is insulated electrically from the outer conductor 102 by the dielectric 106. An external spring 108 is attached by a ring 110 in the contact region 128 for resiliently securing the plug connector 100 to the mating plug connector, and for electrically connecting the outer conductor 102. The external spring 108 may optionally be attached without the ring 110. Outward protrusions 130 on the outer conductor ensure mechanical stability once the dielectric 106, the external spring 108 and the optional ring 110 have been mounted.

In the connection region 132 the outer conductor 102 is brought into electrical contact with a braid 120 of the cable 108. The braid 120 is pushed over the connection region 132 and electrically terminated thereto by a sleeve 116. The sleeve may be crimped to give adequate strain relief. A peripheral latching projection 134 and a ramp 136, which are provided on the center conductor 104, make it possible for the center conductor 104 to latch inside the dielectric 106. Along its internal diameter, the dielectric 106 has a corresponding widening in cross-section or a groove for receiving the latching projection 134 and an associated further ramp 137 (see FIG. 8). The latching can be achieved for example by different angles for the ramps, such as 30° on the center conductor and 34° on the dielectric. Latching can also be performed by the center conductor having a peripheral latching projection which for the purpose of latching engages in an associated groove on the dielectric.

Two hooks 138, which are integrally formed on the second half shell 114, form with corresponding openings in the first half shell 112 a hinge-like attachment. For assembly, the second half shell 114 can be fixed to the first half shell 112 using these hooks 138 by rotating about an axis of rotation running substantially perpendicular to the longitudinal axis of the cable 118. In this way, positioning of the second half shell 114 during assembly is facilitated, and the mechanical stability of the overall construction is increased.

Figure 2:
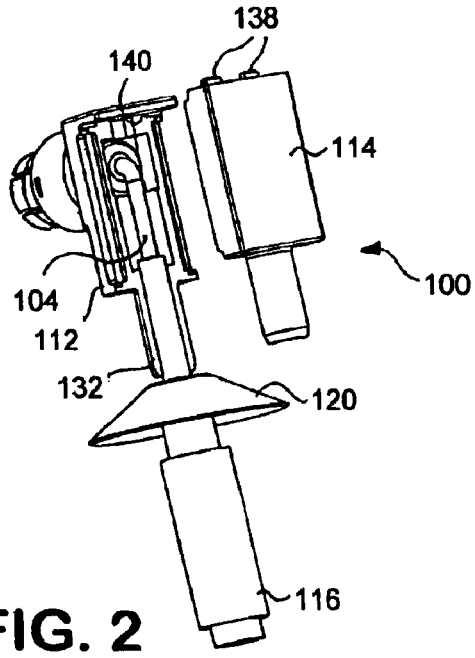
FIG. 2 is a perspective view of the angled plug connector from FIG. 1 before the outer conductor half shells have been joined together.

FIG. 2 shows a perspective illustration of a partially assembled coaxial plug connector 100, in which the external spring 108, the ring 110 and the dielectric 106 have already been applied to the first half shell 112 of the outer conductor 102 and the center conductor 104 is latched to the dielectric 106 and connected to the cable center conductor 122 by a crimping. The cable outer conductor 120 is still folded back and the second half shell 114 is not yet mounted.

Figure 3:
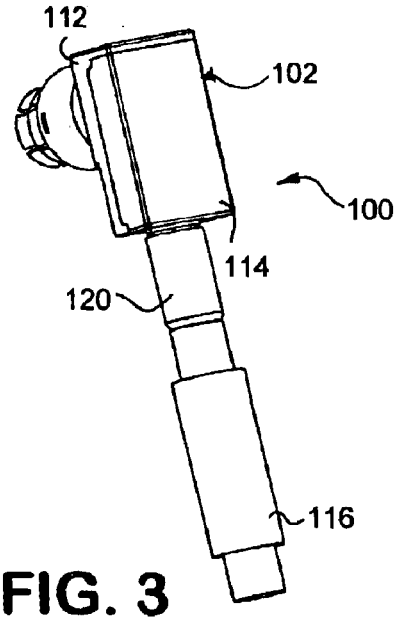
FIG. 3 is a perspective view of the angled plug connector from FIG. 1 before the crimped sleeve has been mounted.

FIG. 3 shows a further assembled coaxial plug connector 100, in which both half shells 112 and 114 are joined together and the outer conductor braid 120 has been pushed over the contact region 132 of the outer conductor 102. It is clearly visible that the entire plug connector arrangement is enclosed on all sides by the shield housing formed by the outer conductor 102.

Figure 4:
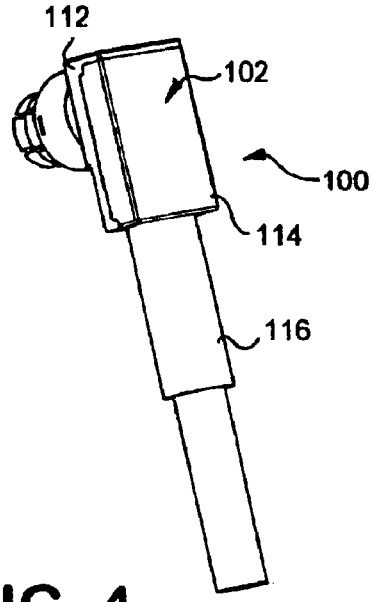
FIG. 4 is a perspective view of the angled plug connector from FIG. 1 in the fully assembled condition.

Once the electrical connection has been made between the outer conductor 102 and the braid 120, as illustrated in FIG. 4, optimum shielding from electromagnetic interference is produced. As shown in FIG. 4, the sleeve 116 is pushed over the contact region 132 and is secured with a crimping tool to provide electrical connection to the half shells 112, 114 and good strain relief.

Figure 5:
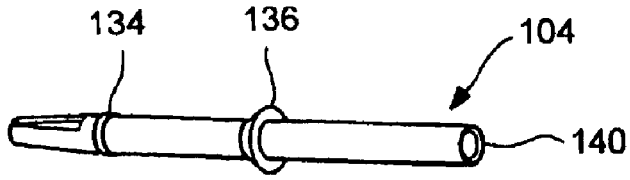
FIG. 5 is a perspective view of a center conductor according to a first embodiment, in the non-angled condition.
Figure 6:
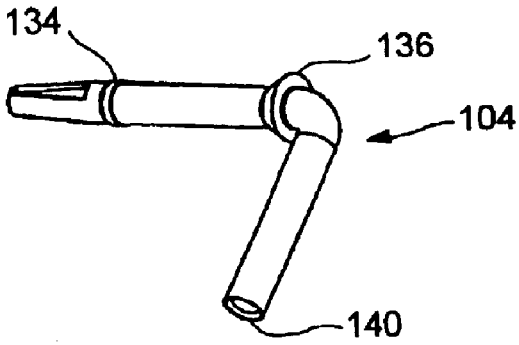
FIG. 6 is a perspective view of the center conductor according to the embodiment from FIG. 5 in the angled condition.
Figure 7:
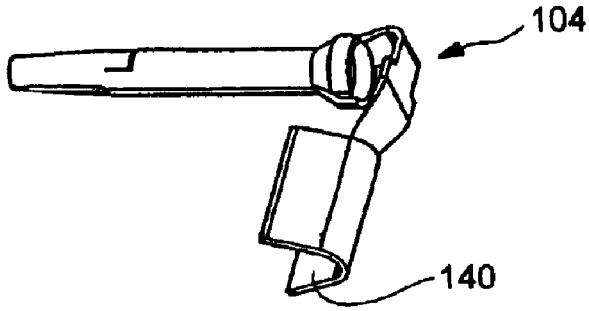
FIG. 7 is a perspective view of an angled center conductor according to a second embodiment.

Various embodiments of the center conductor 104 are shown in FIGS. 5 to 7. The center conductor 104 can be made as a turned part, as shown in FIGS. 5 and 6. The electrical connection to the center conductor 122 of a coaxial cable is made through the connection opening 140 and can crimped or soldered to give better a mechanical and electrical connection. In the case of an angled plug connector, a turned part of this kind can be bent at a right angle, as shown in FIG. 6. The embodiments shown in FIGS. 5 and 6 of the center conductor 104 may also alternatively be made by an extrusion technique. In this case, the latching projection 134 and the ramp 136 are formed by transverse rolling using appropriately shaped transverse rollers. As an alternative, the center conductor may also be made with the aid of an extrusion process. This allows a substantially simpler manufacturing process to be achieved. Since it is a non-cutting manufacturing process, there is no waste and the raw material can be 100% utilised. Extrusion represents a faster process than turning, since depending on the circumference and intensity up to 1000 parts per minute can be manufactured, so production can be sped up substantially. Because the center conductor is made by a shaping technique, the material is compressed and the center conductor has better tensile strength than turned parts of similar shape. Manufacture by the extrusion process has the advantage that the manufacturing tools are subject to substantially less wear during production than with turning. A further embodiment of a center conductor 104 is shown in FIG. 7. The center conductor 104 shown here is made by stamping and forming a metal sheet and has a crimp connection in the area of the connection opening 140 for connecting it to the center conductor 122 of the coaxial cable.

Figure 8:
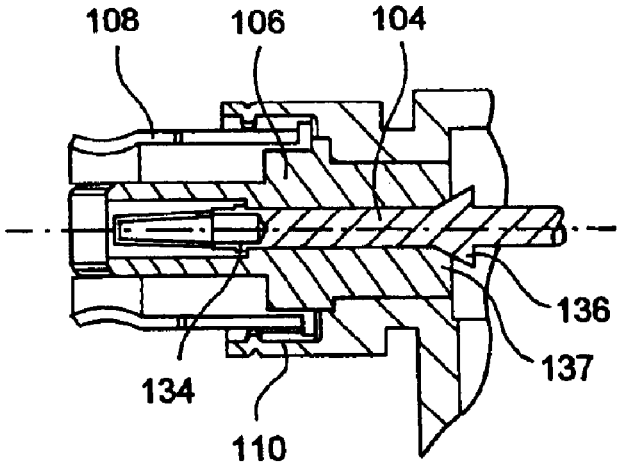
FIG. 8 is a perspective view of a section through the contact region of the coaxial plug connector of FIG. 1 in the assembled condition.

FIG. 8 shows a longitudinal section through the contact region 128 in the fully assembled condition. In this illustration, the way the center conductor 104 is latched to the dielectric 106 is visible. In this embodiment, the latching projection 134 engages in a place where there is a widening of the cross-section of the dielectric 106 and is fixed by the interaction between the two ramps 136 and 137, which for this purpose have different ramping angles.

The individual steps of mounting for making a coaxial angled plug connector according to the present invention will be presented in detail with reference to FIGS. 9 to 21.

Figure 9:
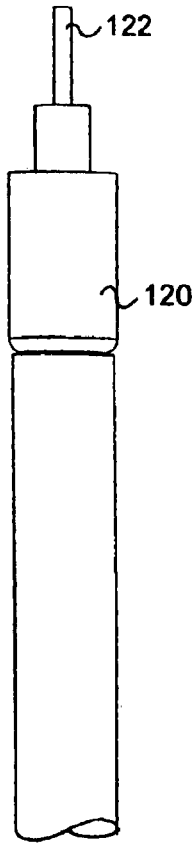
FIG. 9 is a perspective view of a coaxial cable portion having its insulation removed, to which the angled plug connector is to be mounted.

Referring to FIG. 9, first of all a coaxial cable 118 has its insulation removed in a first operating step such that the cable center conductor 122 and the cable outer conductor 120 (usually a wire braid) are exposed. Then, a clamping sleeve 116, as shown in FIG. 10, is pushed over the cable end.

Figure 11:
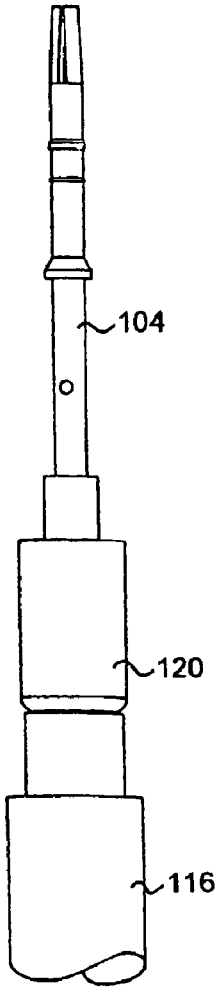
FIG. 11 is a perspective view of the cable portion once a non-angled center conductor has been attached by crimping.
Figure 12:
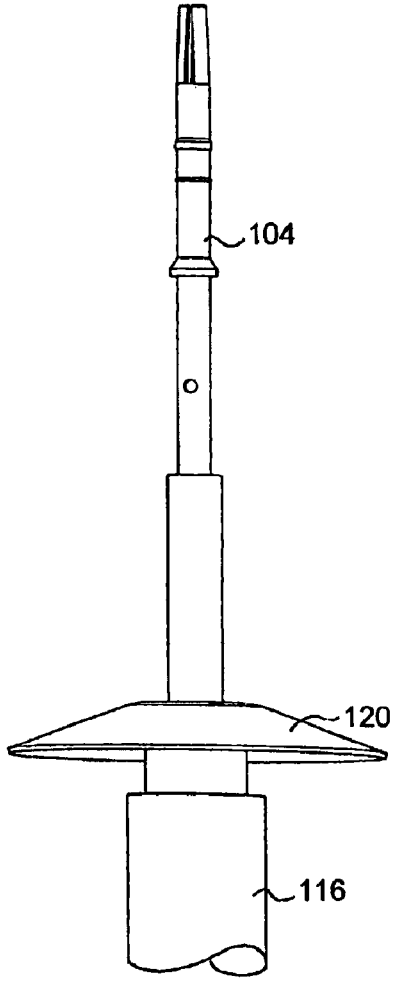
FIG. 12 is a perspective view of the arrangement from FIG. 11 once the cable outer conductor braid has been bent back.

As shown in FIG. 11, it is now possible either to mount a straight center conductor 104 on the cable center conductor 122 and to connect it to the latter by crimping. Then the next operating step is performed, as shown in FIG. 12, by stripping back the braid 120. Angling off the center conductor 104 gives the arrangement shown in FIG. 14.

Figure 10:
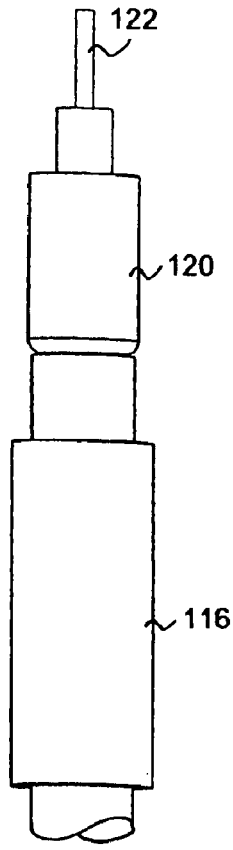
FIG. 10 is a perspective view of the cable portion from FIG. 9 once the clamping sleeve has been mounted.
Figure 13:
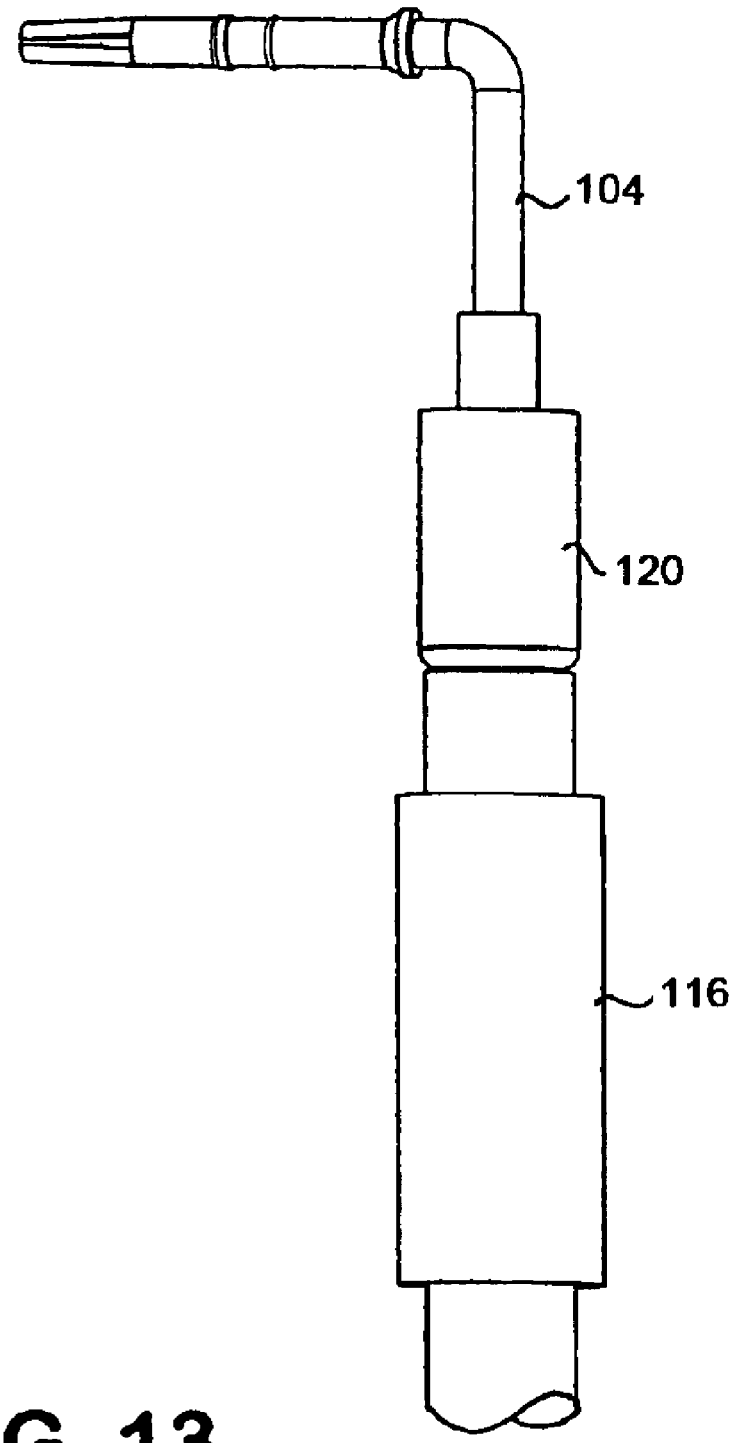
FIG. 13 is a perspective view of the alternative mounting of a bent center conductor on the arrangement from FIG. 10.

As an alternative, however, it is also possible, as shown in FIG. 13, to mount an angled center conductor 104 on the arrangement shown in FIG. 10. In this case, stripping back the braid 120 arrives at the arrangement shown in FIG. 14.

Figure 14:
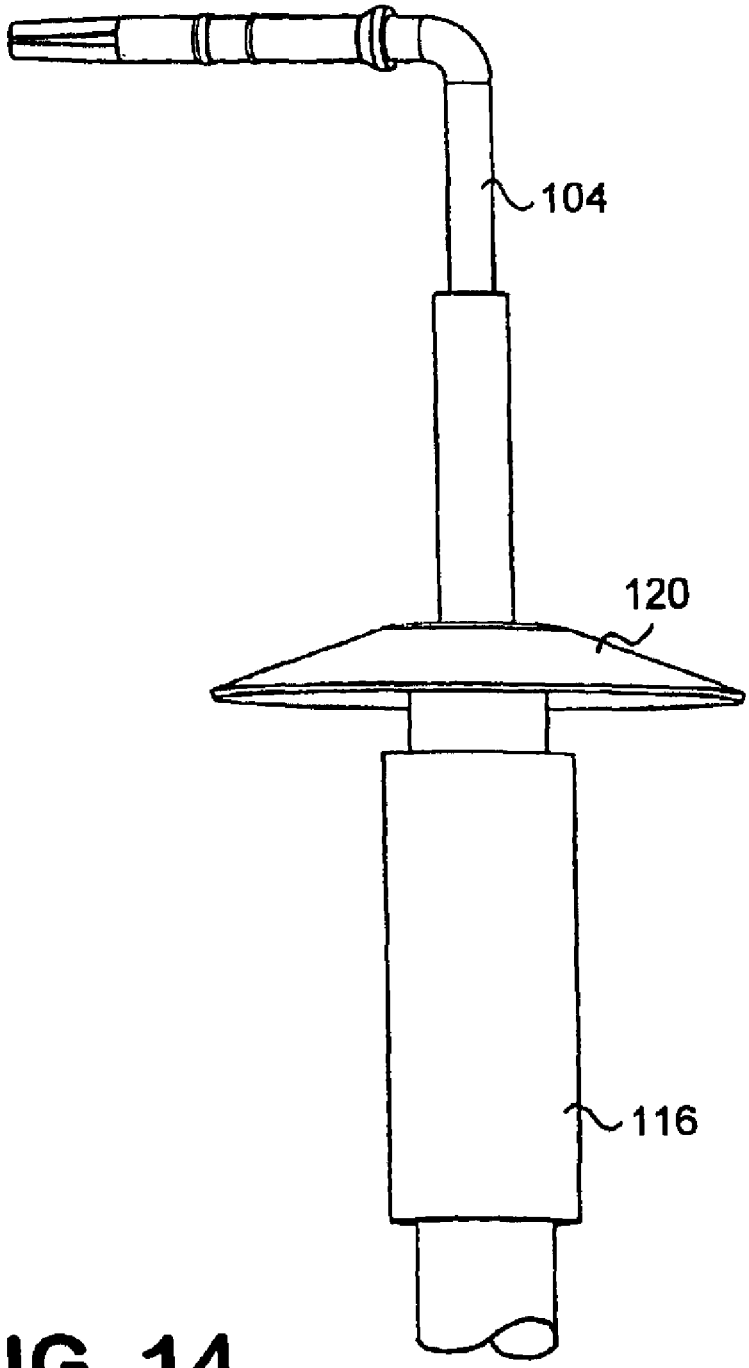
FIG. 14 is a perspective view of the cable end with the cable outer conductor braid bent back and the center conductor bent off.
Figure 15:
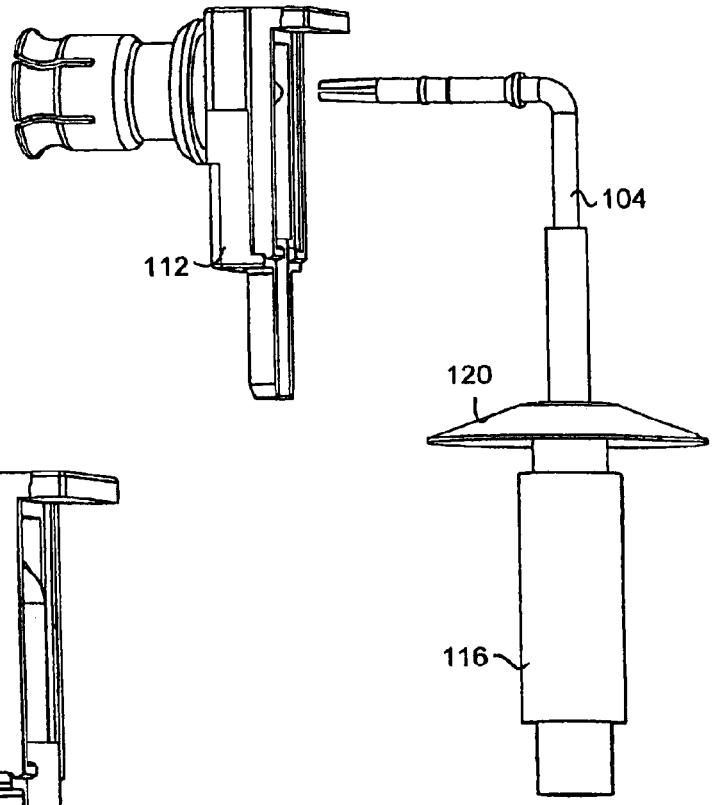
FIG. 15 is a perspective view of the arrangement from FIG. 14 and the first outer conductor half shell before assembly.
Figure 16:
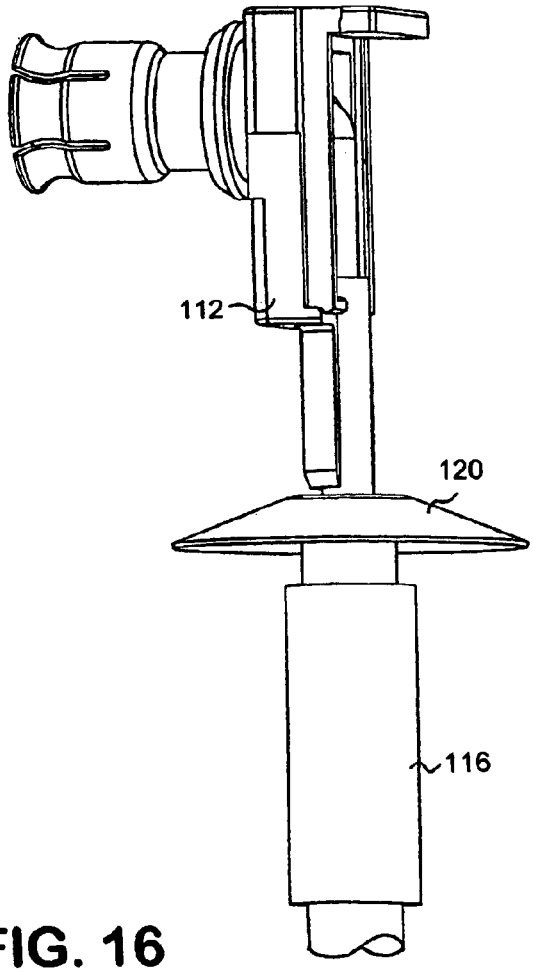
FIG. 16 is a perspective view of the arrangement from FIG. 15 in the joined-together condition.

FIG. 15 shows the arrangement of FIG. 14 with a pre-assembled first half shell 112 into which the dielectric 106 has already been inserted. Latching the center conductor 104 into the dielectric 106 gives the arrangement shown in FIG. 16.

Figure 17:
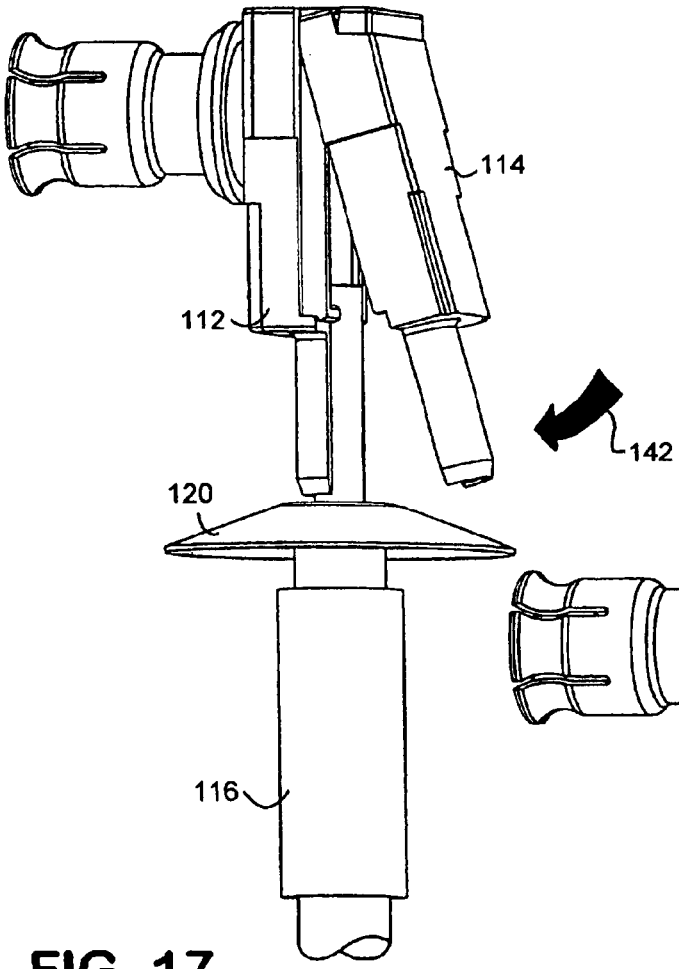
FIG. 17 is a perspective view of the arrangement from FIG. 16 with the second outer conductor half shell attached in the manner of a hinge.
Figure 18:
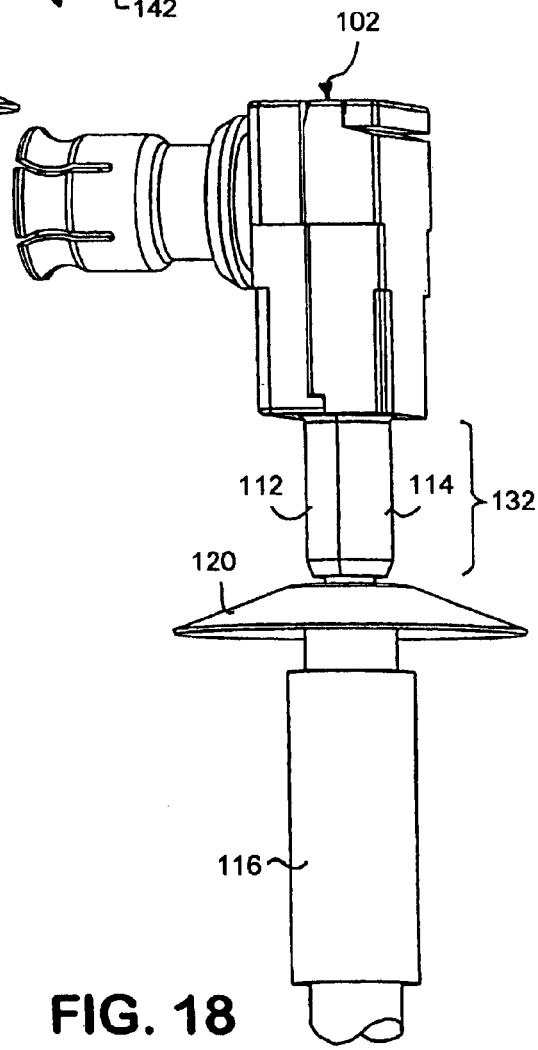
FIG. 18 is a perspective view of the arrangement from FIG. 17 with the second outer conductor half shell folded closed and latched.

In the next step, as shown in FIG. 17, the second half shell 114 is connected to the first half shell 112 by a hinge. Rotating the half shell 114 in the direction 142, about an axis of rotation running transversely with respect to the longitudinal axis of the cable, the two half shells 112, 114 are connected (latched) to one another. As illustrated in FIG. 18, this gives a shield housing which is closed on all sides and is formed by the outer conductor 102. The outer conductor 102 may in this case be made from metal, for example from zinc or aluminium in a die casting technique, or comprise a synthetic material with conductive particles or a conductive coating. This last variant is performed for example by an injection moulding process with a synthetic material which has a filling of metal fibres.

Figure 19:
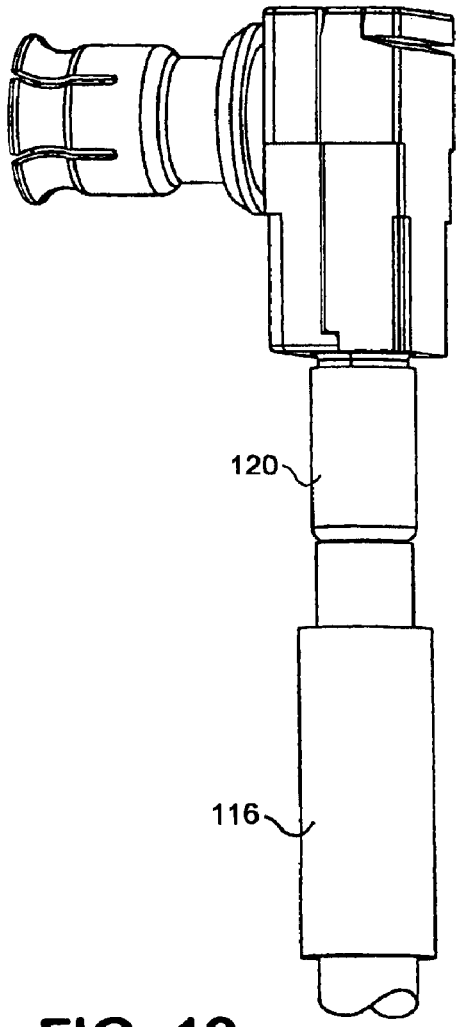
FIG. 19 is a perspective view of the arrangement from FIG. 18 with the cable outer conductor braid slipped over the connection region of the outer conductor.

In order to make an electrically conductive and mechanically firm connection between the connection region 132 of the outer conductor 102 and the braid 120, the braid 120 is first pushed over the connection region 132, which gives the arrangement in FIG. 19.

Figure 20:
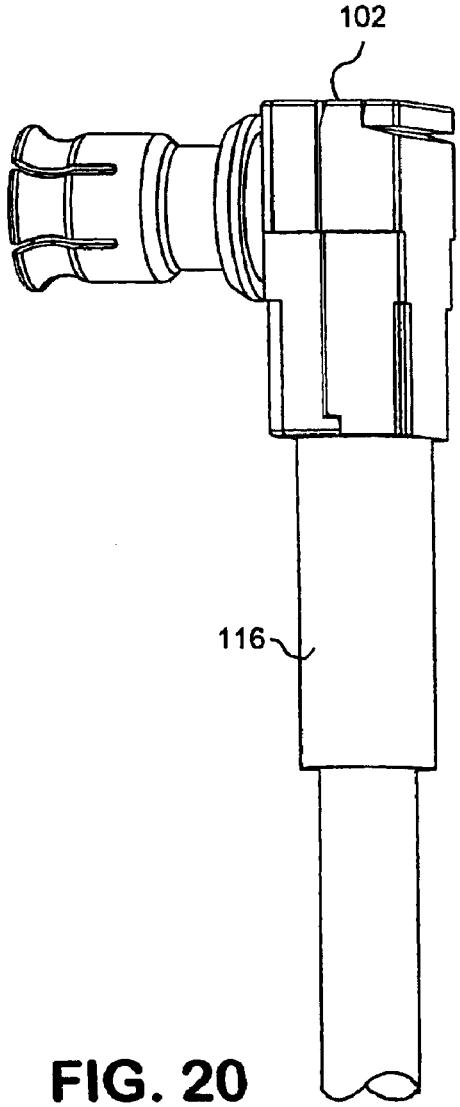
FIG. 20 is a perspective view of the arrangement from FIG. 19 with the clamping sleeve pushed over the braid.

Then, the clamping sleeve 116 is pushed over the braid 120 (see FIG. 20).

Figure 21:
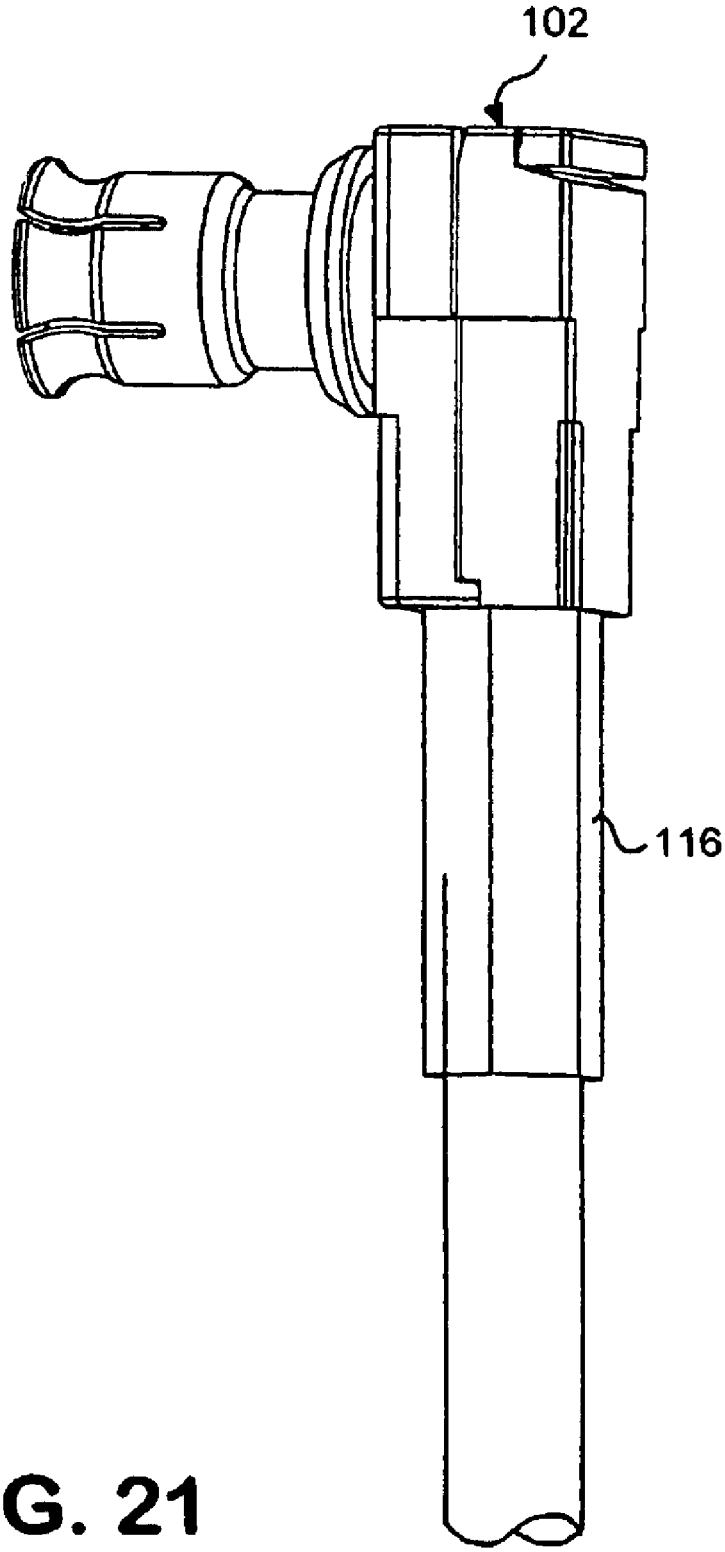
FIG. 21 is a perspective view of the arrangement from FIG. 20 after the last process step of crimping the clamping sleeve.

In a final operating step, the clamping sleeve is fixed using a crimping tool, which gives the fully assembled arrangement shown in FIG. 21.

As an alternative to the steps shown in FIGS. 9 to 21, the braid 120 from which the insulation has been removed may be left over the cable even after the insulation has been removed, and be brought into electrical contact on the inner surface of the connection region 132.

Figure 22:
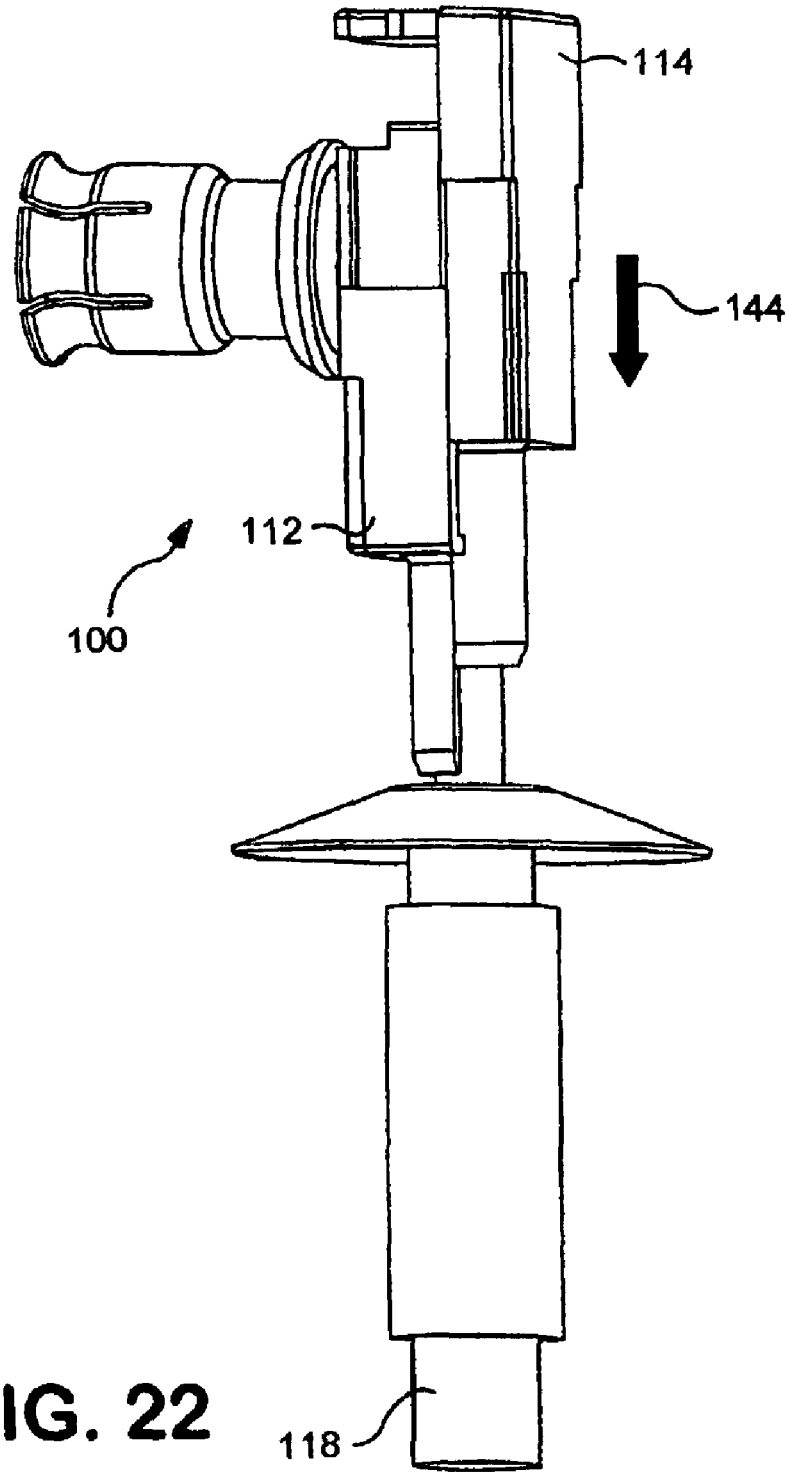
FIG. 22 is a perspective view of a perspective illustration of a coaxial angled plug connector according to a further advantageous embodiment.

FIG. 22 shows a further embodiment of a coaxial plug connector 100 in which the second half shell 114 is not connectable to the first half shell 112 by way of a hinge-like attachment, but may be mounted to the first half shell 112 by being displaced in a direction 144 parallel to the longitudinal axis of the cable 118. Inter-engaging guide elements such as grooves and guide projections may be integrally formed on the wall elements of the half shells 112, 114 that come up against one another. This embodiment may be advantageous if the geometrical relationships during assembly do not permit rotation, and moreover it enables a more reliable connection between the two half shells.

Although only center conductors having a round cross-section in the contact region have been shown in the embodiments shown, the present invention may also be applied with center conductors of square or rectangular cross-section. This is possible in particular when extrusion or punching processes are used.

Lower weight and lower manufacturing costs are an advantage of an alternative embodiment in which the half shells can be made from a synthetic material. For the purpose of electrical shielding, the synthetic material contains conductive fibres or is coated to make it conductive. Manufacture of synthetic half shells of this kind is preferably carried out by means of an injection moulding process.

What is claimed is:

1. A coaxial plug connector comprising:

an electrically conductive shield housing;

a center conductor, which is connectable to a cable center conductor and to a complementary center conductor of a mating plug connector;

an outer conductor which is connectable to an outer conductor of the mating plug connector and to a cable outer conductor, the outer conductor including a first half shell and a second half shell which can be joined together in a direction substantially transverse with respect to the longitudinal axis of the cable, the half shell of the outer conductor forming the shield housing; and, a sleeve which reaches approximately form-fitting around the outer conductor and the cable outer conductor in a connection region.

2. The coaxial plug connector according to claim 1, wherein the sleeve is a crimped sleeve which connects the outer conductor to the cable outer conductor.

3. The coaxial plug connector according to claim 1, wherein a connection region of the outer conductor is constructed such that it can be surrounded by the cable outer conductor when assembled.

4. The coaxial plug connector according to claim 3, wherein the outer conductor surrounds the cable outer conductor in the connection region when assembled.

5. The coaxial plug connector according to claim 1, wherein the outer conductor has a hinge-like attachment for connecting the two half shells by rotation.

6. The coaxial plug connector according to claim 5, wherein the hinge-like attachment has an axis of rotation that runs transversely with respect to the longitudinal axis of the cable.

7. The coaxial plug connector according to claim 5, wherein the hinge-like attachment is formed by at least one hook integrally formed on one of the half shells and engaging in an associated engagement opening on the other half shell.

8.The coaxial plug connector according to claim 1, further comprising a dielectric positioned between the center conductor and the outer conductor, the center conductor being latchable to the dielectric.

9. The coaxial plug connector according to claim 8, wherein the center conductor has a peripheral latching projection which engages in an associated recess in the dielectric.

10. The coaxial plug connector according to claim 9, wherein the center conductor has a peripheral ramp which engages in an associated second ramp on the dielectric.

11. The coaxial plug connector according to claim 1, wherein the coaxial plug connector is an angled plug connector in which the longitudinal axis of the cable runs substantially transversely with respect to the mating direction into the mating plug connector.

12. The coaxial plug connector according to claim 11, wherein the center conductor has a contact region for making a connection with the center conductor of the mating plug connector and a connection region for connection to the cable center conductor and the center conductor is angled such that the contact region and the connection region are oriented at approximately a right angle to each another.

13. The coaxial plug connector according to claim 1, wherein the center conductor may be made as a turned part, by punching and bending or as an extruded part.

14. The coaxial plug connector according to claim 1, wherein the center conductor is connectable to the cable center conductor by one of a crimp connection, a solder connection and a push-in connection.

15. The coaxial plug connector according to claim 1, wherein the half shells can are made of metal by one of a die casting technique and a cutting-machining process.

16. The coaxial plug connector according to claim 1, wherein the half shells are made by one of a synthetic material with a filler of conductive fibers and a synthetic material with a conductive coating.

17. The coaxial plug connector according to claim 16, wherein the first half shell and/or the second half shell are constructed by a plurality of parts.

18. A coaxial angled plug connector comprising:

an electrically conductive shield housing;

a center conductor, being made as a turned part, which is connectable in a connection region to a cable center conductor and in a contact region to a complementary center conductor of a mating plug connector;

an outer conductor which is connectable to an outer conductor of the mating plug connector and to a cable outer conductor, in which the center conductor is angled such that the contact region and the connection region form an angle of approximately 90° with one another; and, a sleeve which reaches approximately form-fittingly around the outer conductor and the cable outer conductor in a connection region.

19. A process for making a coaxial plug connector, comprising the steps of:

(a) mounting a center conductor in a first half shell of an outer conductor, in which the center conductor is insulated from the first half shell by a dielectric, (b) connecting the center conductor to a cable center conductor, (c) mounting a second half shell of the outer conductor whereby the first half shell and the second half shell of the outer conductors form an electrically conductive shield housing, and (d) connecting a connection region of the outer conductor to a cable outer conductor by applying and crimping a sleeve around the outer conductor.

* * * * *